United States Patent [19]

Humble et al.

[11] Patent Number: 4,813,986

[45] Date of Patent: Mar. 21, 1989

[54] PROCESS FOR THE LOW TEMPERATURE DERIMING OF CRYOGENIC HEAT EXCHANGERS

[75] Inventors: John D. Humble, Lawrenceville, N.J.; Tsoung Y. Yan, Philadelphia, Pa.

[73] Assignee: Mobil Oil Corporation, New York, N.Y.

[21] Appl. No.: 107,749

[22] Filed: Oct. 13, 1987

[51] Int. Cl.[4] ..... F25J 5/00

[52] U.S. Cl. ..... 62/12; 55/72; 62/303; 165/95

[58] Field of Search ..... 62/20, 303, 12; 55/74; 165/95

[56] References Cited

U.S. PATENT DOCUMENTS

| | | | |
|---|---|---|---|
| 3,193,987 | 7/1965 | Manes et al. | 55/72 |
| 3,593,535 | 7/1971 | Gaumer, Jr. et al. | 62/23 |
| 3,714,979 | 2/1973 | Stevens | 165/95 |
| 3,803,803 | 4/1974 | Raduly et al. | 55/72 |
| 3,818,975 | 6/1974 | Tokumitsu et al. | 165/95 |
| 4,101,631 | 7/1978 | Ambrosini et al. | 55/72 |
| 4,420,317 | 12/1983 | Stewart | 62/20 |
| 4,474,896 | 2/1984 | Chao | 55/74 |
| 4,491,609 | 1/1985 | Degel et al. | 427/215 |
| 4,500,327 | 2/1985 | Nishino et al. | 55/72 |
| 4,589,898 | 5/1986 | Beaver | 165/95 |

OTHER PUBLICATIONS

Geist et al., "Predicted and Actual Temperature Profiles and Pressure Drops in Large Coil Wound, Mixed Refrigerant Heat Exchangers," LNG-6, Session II, Paper 4, Apr. 7-10, 1980, Kyoto, Japan.

*Primary Examiner*—Ronald C. Capossela
*Attorney, Agent, or Firm*—Alexander J. McKillop; Charles J. Speciale

[57] ABSTRACT

The deriming of the interior surfaces of cryogenic heat exchangers employed in the liquefaction of mercury-containing gases, in particular, natural gas, is accomplished by contacting the solids present upon the interior surfaces of the heat exchanger, usually as ice and hydrocarbonaceous materials, with a solvent or mixture of solvents at a temperature which is at or below the freezing point of mercury whereby solids will dissolve in the solvent and be removed from the interior surfaces of the heat exchanger and a substantial part of the mercury present within the heat exchanger will be in the solid state. In this way, the corrosive effects of elemental mercury vapor upon the heat exchanger, especially in the cases where aluminum is the material of construction, can be greatly lessened or minimized.

18 Claims, 1 Drawing Sheet

PROCESS FOR THE LOW TEMPERATURE DERIMING OF CRYOGENIC HEAT EXCHANGERS

BACKGROUND OF THE INVENTION

This invention relates to a process for the deriming of heat exchangers at low temperatures, and, in particular, deriming heat exchangers which are contaminated with mercury, such as those used for liquefaction of natural gas.

The liquefaction of natural gas for storage and transportation and regasification for final distribution is a well established technology. Liquefied natural gas (LNG) represents an economically attractive energy option, especially for industrial nations short on domestic fuel reserves.

Several types of natural gas liquefaction processes are known. One conventional LNG process, the standard cascade system, uses three different refrigerants, i.e., methane, ethylene and propane, circulating in closed cycles. An example of such a system is described in U.S. Pat. No. 3,593,535. An improvement over the standard cascade system employs a single-pressure mixed refrigerant cascade (MRC) system. In one version of the MRC system described in Geist et al., "Predicted and Actual Temperature Profiles And Pressure Drops in Large Coil Wound, Mixed Refrigerant Heat Exchangers," *LNG6*, Session II, Paper 4, Apr. 7, 1980, Kyoto, Japan, a natural gas feed following treating and drying is precooled in an auxiliary heat exchanger supplied with propane refrigerant. Thereafter, the chilled gas is introduced into a cryogenic main heat exchanger (MHE) where liquefaction takes place. The MHE is horizontally divided into an upper cold bundle absorbed by propane and a lower warm bundle absorbed by mixed refrigerant.

In any natural gas liquefaction process, there will be progressive accumulation of water, as ice, and relatively heavy hydrocarbons present in the gas feed in solid form upon the interior surfaces of the MHE. At some point the accumulation will be sufficient to hinder the efficient operation of the process. In particular, there will be an increased pressure drop and a decrease of the heat transfer rate along the surfaces of the MHE. Consequently, a deriming, or defouling procedure will be required to restore the efficiency of the liquefaction process to some acceptable level. Conventional deriming practice calls for warming the heat exchanger to about 60°–70° C. and purging it with dry nitrogen gas.

Regardless of the liquefaction system used, aluminum is often the material of choice for the construction of the cryogenic heat exchanger due to its high thermal conductivity, excellent low temperature properties, machinability and relatively low cost. However, aluminum is susceptible to corrosion by mercury which is present in natural gas, e.g., from as low as about 0.005 to as high as about 200 micrograms per normal cubic meter (i.e., from about $5.5\times10^{-3}$ to about 220 parts per billion by volume). Concentrations of mercury greater than about 0.01 micrograms per normal cubic meter are generally regarded as undesirable especially where aluminum cryogenic liquefaction equipment is concerned due to mercury's capability for forming a corrosive amalgam with aluminum. Although it is a conventional practice to demercurate natural gas (see, for example, the demercuration processes described in U.S. Pat. Nos. 3,193,987; 3,803,803; 4,101,631; 4,474,896; 4,491,609; 4,474,896; and, 4,500,327), a sufficient amount of elemental mercury will often remain in the post-treated gas as to pose a significant safety and maintenance problem where aluminum cryogenic heat exchangers are concerned. Thus, during the aforedescribed conventional deriming procedure, warming of the heat exchanger to 60°–70° C. causes melting of any solid elemental mercury which may be present therein thus permitting the mercury to destroy the heat exchanger through embrittlement and amalgamation with the aluminum.

It is an object of the present invention to provide a process for deriming cryogenic equipment employed in the liquefaction of natural gas.

It is a particular object of this invention to carry out the deriming of cryogenic heat exchangers fabricated from aluminum in a manner which minimizes the corrosive potential of elemental mercury vapor, a normal component of natural gas, for the aluminum.

SUMMARY OF THE INVENTION

In accordance with the present invention, a process for deriming the interior surfaces of a cryogenic heat exchanger employed in the liquefaction of a mercury-containing gas is provided which comprises contacting the solids present upon the interior surfaces of the heat exchanger with a solvent or mixture of solvents at a temperature which is at or below the freezing point of mercury whereby solids will dissolve in the solvent and be removed from the interior surfaces of the heat exchanger while the mercury present within the heat exchanger is in the solid state.

While the deriming solution can be introduced at virtually any location in main heat exchanger, the present process has been found to be particularly effective when the solution is introduced to the top of the heat exchange vessel since the trickle-down of the deriming solution minimizes the requirement to fill the vessel with liquid to all levels where the deriming should be conducted. Thus, the ultimate liquid weight load on the heat exchange vessel can be virtually eliminated. In this mode, the solvent can also be dried by directing it through a dryer provided with, for example, a molecular seive for separating moisture from the solvent.

Even though the advantages of the foregoing deriming process are especially pronounced in the case of aluminum cryogenic equipment, it has advantages for such equipment constructed from other materials, e.g., steels of all kinds including stainless steel. Where aluminum cryogenic heat exchangers are concerned, the most important advantage of the deriming process of this invention is based on the observation that in the solid state, elemental mercury will exhibit little, if any, corrosive effect upon aluminum. Accordingly, by maintaining the temperature of the deriming solvent at or below the temperature at which the mercury present in the heat exchanger is, or will be, in the solid state, the opportunity of the mercury to form an amalgam with the aluminum of the heat exchanger and thus cause corrosive failure and/or stress corrosion cracking of the heat exchanger is greatly minimized.

DESCRIPTION OF THE PREFERRED EMBODIMENTS

Figure 1:
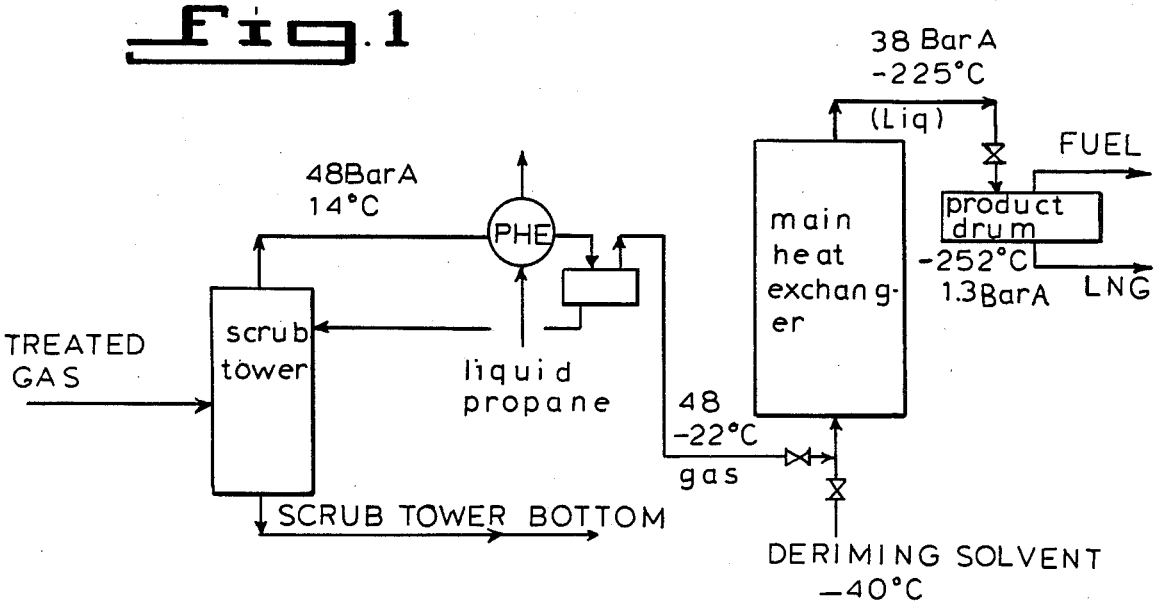
FIG. 1 is a schematic diagram of one embodiment of the deriming process of this invention applied to a known type of natural gas liquefaction operation.

In accordance with FIG. 1 of the drawings, natural gas containing mercury in the vapor state is introduced into a scrub tower with the overhead gas being taken off at about 48 BarA and 14° C. and introduced into a precooling heat exchanger (PHE) supplied with liquid propane refrigerant. Passage of the gas at pressure through the PHE reduces its temperature to about −22° C. A minor portion of the chilled gas is recycled to the top of the scrub tower, the major portion of the gas being introduced to the MHE wherein liquefaction takes place. The LNG product from the MHE, now at 38 BarA and about −225° C. is introduced into the product drum with evaporation of a light fraction which is taken off as a gaseous fuel cooling the remaining LNG to its final storage/transportation temperature of about −252° C.

Eventually, due to the accumulation of ice crystals and heavy hydrocarbons on its interior surfaces, efficient operation of the MHE is no longer possible and deriming in accordance with this invention is then carried out. When this point has been reached as determined, e.g., by a quantifiable drop in pressure and/or decreased heat transfer rate, the gas feed to the MHE is interrupted and a deriming solvent at a temperature which is at least at, or just below, the freezing point of mercury, and which may, in fact, be substantially less than this temperature, e.g., from about −40° C. to about —90° C., is caused to pass through the MHE. The deriming solvent can be injected to the natural gas stream at a temperature of from about −40° C. to about −90° C. The natural gas becomes the carrier gas for the solvent. The injection of solvent can be intermittent.

The deriming solvent may consist of a single solvent material, e.g., methanol, ethers, etc. which remains liquid at the deriming temperature and which is capable of dissolving both water (ice) and the sort of hydrocarbonaceous materials associated with the fouling deposits in LNG process equipment. The deriming solvent may also consist of two or more solvents having different solubilities for water and hydrocarbons but suitable for use at driming temperatures of −40° C. and below. Thus, for example, a solvent mixture based on methanol and such other solvents as methylene chloride, acetone, carbon disulfide, etc., which act primarily to dissolve the hydrocarbon accumulations, can be used to good effect in the process of this invention the MHE is purged with nitrogen at −40° C. to −90° C. to remove the solvent, or purged with liquid propane/butane to remove the solvent. Upon completion of the deriming procedure, the MHE can be restored to operation as before.

Methanol is especially advantageous for use in the deriming process of this invention since its freezing point and boiling points of −98° C. and 65° C., respectively, permit easy handling of this relatively low cost material. The solubilities of water in methanol at −96° C. and −40° C. are high at 30 weight percent and 40 weight percent, respectively. The water solubility increases as temperature is increased. With such a solvent, the deriming process of this invention can be carried out effectively, rapidly and at low cost with fairly minimum down time. Upon completing the washing, the methanol solvent can be readily removed with liquid propane/butane. Methanol consumption in such an operation can, with careful management, be kept to a minimum, the methanol being suitable for recycle upon dehydration, e.g., over 3–4 angstrom molecular sieves.

Figure 2:
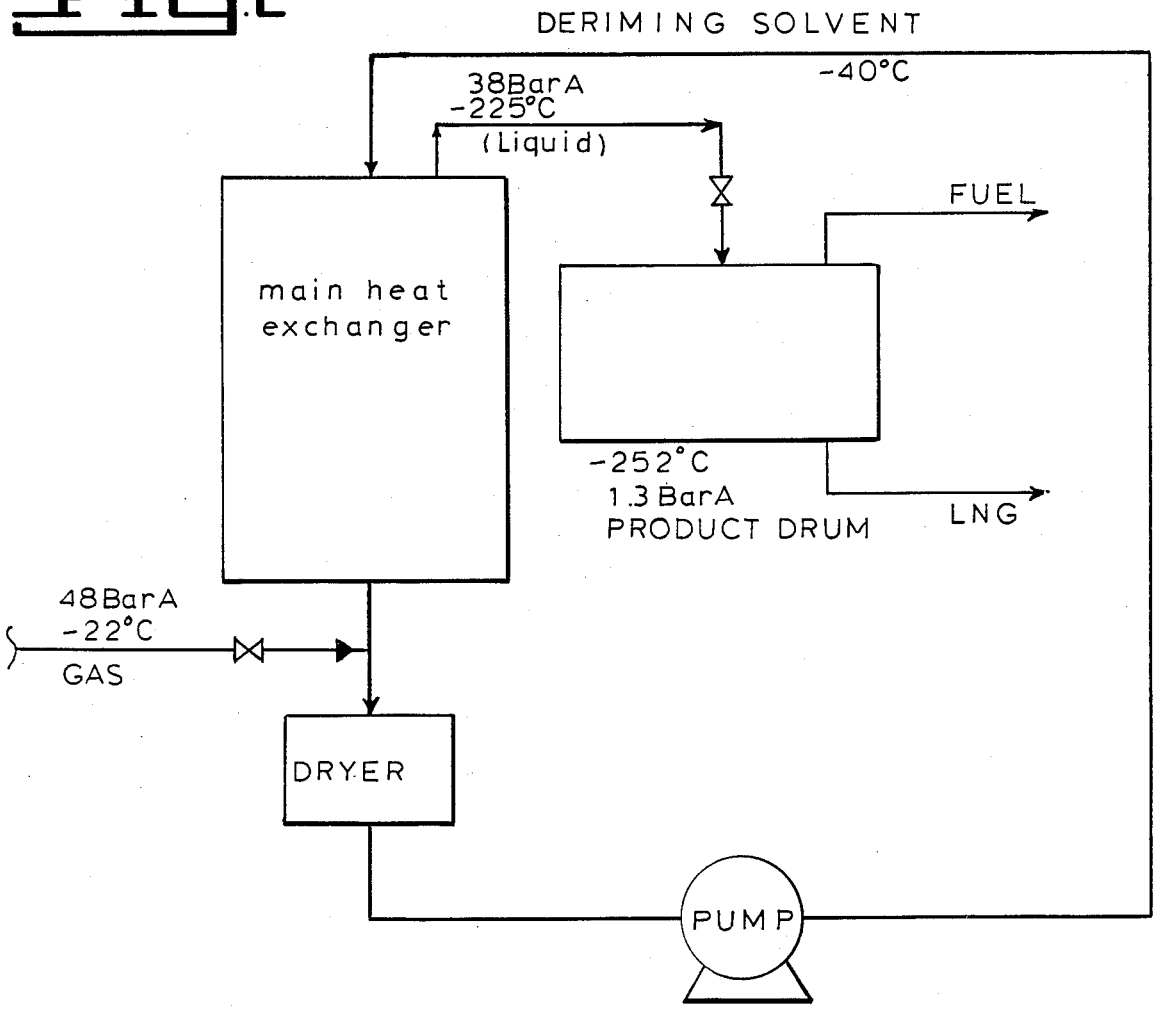
FIG. 2 is a partial schematic of the process shown in FIG. 1 wherein the solvent is introduced and recirculated into the top of the heat exchanger.

Referring to FIG. 2 a most preferred embodiment of the present invention is depicted wherein the deriming solvent is introduced into the top of the main heat exchanger vessel. This method permits removal of the unwanted accretion of ice and long chain hydrocarbons without building up a liquid load in the heat exchanger. It will be appreciated that when the solvent is introduced into the bottom of the vessel it is necessary to fill the vessel with solvent until it reaches all the unwanted material throughout the length of the vessel. The embodiment of FIG. 2 overcomes this requirement. Thus high volumes of solvent and added weight load are both eliminated. Furthermore recirculation of the solvent through, for example, a dryer and back through the vessel is facilitated by gravity feed through half of the cycle. As in the previous embodiment, the solvent can be fed continuously or intermittently by simply controlling a pump provided in the cycle.

Thus, while there have been described what are presently believed to be the preferred embodiments of the present invention, those skilled in the art will realize that other and further modifications and changes can be made without departing from the spirit of the invention, and it is intended that the claims include all such modifications and changes as come within the true scope of the invention.

What is claimed is:

1. A process for deriming the interior surfaces of a cryogenic heat exchanger employed in the liquefaction of a mercury-containing gas which comprises contacting the interior surfaces of said heat exchanger with a deriming solvent or mixture of solvents at a temperature which is at or below the freezing point of mercury whereby undesirable deposits upon said interior surfaces will dissolve in said solvent and be removed from the interior surfaces of said heat exchanger while at least a substantial part of any mercury present within said heat exchanger remains in the solid state.

2. The process of claim 1 wherein said heat exchanger is fabricated from aluminum.

3. The process of claim 1 wherein said gas is natural gas.

4. The process of claim 1 wherein said deriming solvent or mixture of solvents is introduced to said heat exchanger at a temperature of about −40° C. or lower.

5. The process of claim 4 wherein said deriming solvent or mixture of solvents is continuously injected into said gas whereby said deriming solvent is carried into said heat exchanger.

6. The process of claim 4 wherein said deriming solvent or mixture of solvents is intermittently injected into said gas whereby said solvent is carried into said heat exchanger.

7. The process of claim 4 which further comprises purging said heat exchanger of said deriming solvent or mixture of solvents remaining after deriming with an agent selected from the group consisting of natural gas, liquid propane/butane, light hydrocarbons, nitrogen, other inert gases, and mixtures thereof.

8. The process of claim 1 wherein at least a portion of said deriming solvent or mixture of solvents is dried and recirculated for deriming.

9. The process of claim 1 wherein said deriming solvent or mixture of solvents is introduced to said heat exchanger at the top thereof for travel through the length of said heat exchanger under the force of gravity.

10. The process of claim 9 wherein at least a portion of said deriming solvent or mixture of solvents is dried and recirculated through said heat exchanger.

11. The process of claim 9 wherein said deriming solvents or mixture of solvents is continuously fed through said heat exchanger.

12. The process of claim 9 wherein said deriming solvent or mixture of solvents is intermittently fed through said heat exchanger.

13. The process of claim 1 wherein said deriming solvent is methanol.

14. The process of claim 1 wherein said deriming solvent is a mixture of solvents containing a solvent selected from the group consisting of methanol, acetone and ethers.

15. The process of claim 14 wherein said mixture of solvents contains methanol and at least one co-solvent selected from the group consisting of methylene chloride, acetone and carbon disulfide.

16. The process of claim 1 wherein said undesirable deposits include water in the form of ice.

17. The process of claim 1 wherein said undesirable deposits include hydrocarbons.

18. The process of claim 17 wherein said undesirable deposits include water in the form of ice.

* * * * *